US006111360A

United States Patent [19]

Dietze

[11] Patent Number: 6,111,360

[45] **Date of Patent: *Aug. 29, 2000**

[54] FLUORESCENT DISCHARGE LAMP WITH OVERCURRENT PROTECTION

[75] Inventor: Werner Dietze, Maienfeld, Switzerland

[73] Assignee: Bruno Dietze, Coburg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/024,062

[22] Filed: Feb. 17, 1998

[30] Foreign Application Priority Data

Dec. 13, 1997 [DE] Germany ..... 197 55 538

[51] Int. Cl.[7] ..... H05B 37/02

[52] U.S. Cl. ..... 315/56; 315/71; 337/142; 337/290; 337/295; 445/23

[58] Field of Search ..... 315/56, 71; 337/290, 337/295, 246, 227, 298, 142; 445/23

[56] References Cited

U.S. PATENT DOCUMENTS

| | | | |
|---|---|---|---|
| 1,867,924 | 7/1932 | Roberts et al. | 337/290 |
| 3,505,630 | 4/1970 | Merrill et al. | 337/228 |
| 4,158,188 | 6/1979 | Howard | 337/290 |
| 4,922,155 | 5/1990 | Morris et al. | 315/71 |
| 5,272,804 | 12/1993 | Morrill, Jr. et al. | 29/623 |
| 5,545,950 | 8/1996 | Cho | 315/56 |
| 5,596,247 | 1/1997 | Martich et al. | 315/71 |

FOREIGN PATENT DOCUMENTS

| | | | |
|---|---|---|---|
| 378295 | 8/1939 | Italy | 337/290 |
| 5205587 | 8/1993 | Japan | 337/290 |
| 890892 | 9/1989 | WIPO | 337/290 |

*Primary Examiner*—Michael B Shingleton
*Attorney, Agent, or Firm*—Brown & Wood, LLP

[57] ABSTRACT

A fluorescent discharge lamp including a housing with a base, series electronics, and an overcurrent protection element formed of two connection leads having ones of their ends electrically welded to opposite ends of a fuse wire, with the free ends of the connection leads defining contact positions.

2 Claims, 1 Drawing Sheet

FLUORESCENT DISCHARGE LAMP WITH OVERCURRENT PROTECTION

BACKGROUND OF THE INVENTION

1. Field of the Invention

The present invention relates to a fluorescent discharge lamp including a housing with a base, a series electronics located in the housing, and overcurrent protection means including a fuse wire and two connection leads which are connected by welding, with the ends defining contact positions one of which is associated with a free end of a, connection lead.

2. Description of the Prior Art

A fluorescent discharge lamp of the type referred to above includes a sealing wire welded between one of the connection leads and the fuse wire. For welding the connection leads with the fuse wire and the sealing wire, gas welding is used. Gas welding is a relatively expensive method, primarily because it is rather time consuming. In addition, for forming the overcurrent protection, three welding connections are necessary which increases the expenses associated with producing the fluorescent discharge lamps of the type described above.

Accordingly, an object of the present invention is to provide a fluorescent discharge lamp the overcurrent protection of which would require fewer welding connections.

SUMMARY OF THE INVENTION

This and other objects of the present invention, which will become apparent hereinafter, are achieved by connecting both connection leads directly with the fuse wire, with the free ends of both connection leads defining contact positions, and with the connection leads being connected with the fuse wire by electric welding.

The overcurrent protection of a fluorescent discharge lamp according to the present invention permits to eliminate the sealing wire, as the feed for the series electronic is not fused. The elimination of the sealing wire permitted to eliminate one welding connection. Only two welding connections formed between the contact leads and the fuse wire remained, which could be formed by electric welding. The electric welding is less time consuming than gas welding. As a result, the expenses associated with the formation of welding connections are substantially reduced. During electrical welding step, the wires are held adjacent to their welded ends with clamps, with the weldable ends being somewhat spaced. An electrical arc is passed between the two adjacent ends, with the ends being pressed toward each other. The method of forming the overcurrent protection means according to which the connection leads are connected by electrical welding, with an electrical arc passing between respective ends of the connection leads and the fuse wire and with respective ends being pressed toward each other, also forms part of the present invention.

The overcurrent protection means for a fluorescent discharge lamp according to the present invention is characterized in that the ends of the fuse wire and respective ends of the connection leads are axially aligned, then are pressed toward each other, and current is passed between adjacent ends of the fuse wire and the connection leads. Thereby, the ends of the fuse wire and the respective ends of the connection leads are fused with each other, forming bulging welds which define connection with spots.

Fluorescent discharge lamps according to the present invention are primarily formed as compact lamps or low consumption lamps. In compact lamps, the overcurrent protection element is relatively short and is formed of three wire sections. The fuse wire of the overcurrent protection element is usually located in a protected and screened glass housing or the like which is filled with glass beads. However, the fuse wire can be also exposed. The contact positions are usually formed as a solder joint.

The fuse wire melts when overcurrent flows therethrough. The fuse wire is formed, e.g., of a nickel wire, of wire formed of nickel-manganese alloy (e.g., NiMn2 or NiMn5), of NiCu alloy (e.g., monel or constantant), Ni—Fe alloy (e.g. FN 70), or Cr—Ni alloy. The wire has, as a rule, a diameter of 0.125–0.3 mm and a length of 5–30 mm.

The both connection leads can be formed of the same material or different materials, e.g., be formed of a copper-sheathed steel, or be formed of copper, bronze, and be tin- or zink-coated. They can also be formed of pure nickel, nickel-plated steel, DUMET™ or CuNi-alloy. The diameter of connection leads is usually about 0.2–0.8 mm, and they may have a length of about 5–100 mm. The two connection leads can be of the same size or of different size.

It is particularly preferable and advantageous when one contact position of the two connection leads is associated with the series electronics and the other contact position lies on the end terminal of the base. It is important that the overcurrent protection element is located in a limited space.

BRIEF DESCRIPTION OF THE DRAWINGS

The features and objects of the present invention will become apparent, and the invention itself will be best understood from the following detailed description of the preferred embodiments when read with reference to the accompanying drawings, wherein:

FIG. 1 shows a cross-sectional view of a fluorescent discharge lamp with overcurrent protection according to the present invention; and.

DETAILED DESCRIPTION OF THE PREFERRED EMBODIMENTS

Figure 2:
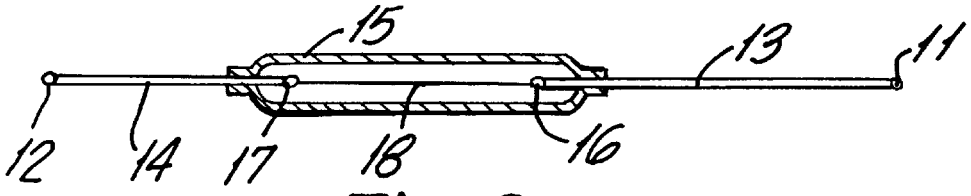
FIG. 2 shows a cross-sectional view of an overcurrent protection element for the fluorescent discharge lamp shown in FIG. 1, at a scale greater than that of FIG. 1.
Figure 1:
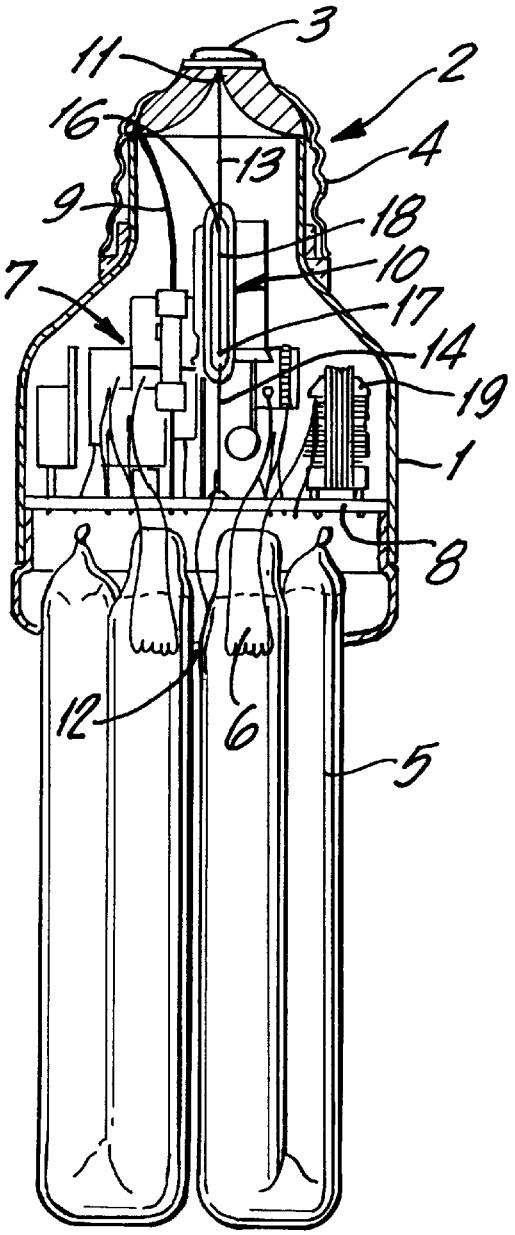

A fluorescent discharge lamp with an overcurrent protection, which is shown in FIG. 1, includes a housing 1 which is formed of a sheet metal or plastics and has, at one of its end, a base 2 provided with first 3 and second 4 electrical connection contacts. At the end of the housing 1 opposite to the base 2, there are provided discharge tubes 5 projecting out of the housing 1 and in which an electrical filament 6 is located. For purposes of the present invention, the number of discharge tubes and associated filaments is irrelevant. In the housing 1, series electronics 7 is arranged. The series electronics 7 includes a plate 8 and a circuit element 19 which is connected by a connecting conductor 9 with a connection contact 4 and is connected, via an overcurrent protection element 10, with another connection contact 3. The circuit element includes capacitors, transformers, resistances, and tyristors.

The overcurrent protection element 10 forms with one of its end a contact position 11 on the connection contact 3 and with its other end a contact position 12 on the plate 8. the protection element 10 with leads 13, 14 is located in a narrowly limited free space between the case 2 and the plate 8 of the series electronics 7. A connection lead 13, 14 extends from each of the contact positions 11, 12, respectively. Each of the leads 13, 14 has one of its ends received in a protection housing 15 where the respective lead ends are connected with a fuse wire 18 by electro-welding spots 16, 17, respectively, which form fusion swellings at respective butt joints of the fuse wire 18 with the leads 13, 14. The overcurrent protection element 10 forms a connecting conduit for the series electronics 7 and the plate or board 8. It is conveniently located with respect to the circuit elements of the series electronics 7, and its location facilitates the assembly of the lamp.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A fluorescent discharge lamp, comprising:

a housing having a base;

a series electronics located in the housing and including a plate and a circuit element arranged on the plate;

contact means for supplying power to the circuit element and including a first contact position associated with the base, a second contact position provided on the plate, and lead means connecting the first and second contact positions and arranged in a free narrowly limited space between the base and the plate; and protection means for protecting the series electronics from overcurrent;

wherein the lead means comprises two axially aligned and spaced from each other connection leads having respective remote ends thereof connected with the first and second contact positions, respectively, and wherein the protection means comprises a fuse wire arranged in a space between the two connection leads in an axially alligned relationship with the two connection leads and having opposite ends thereof butt-joined with respective proximate ends of the two connection leads, and two electrically-formed welds connecting the opposite ends of the fuse wire with the respective proximate ends of the two connection leads and forming respecting fusion swellings at respective butt joints of the opposite ends of the fuse wire with the respective proximate ends of the two connection leads.

2. A method of providing overcurrent protection means in a fluorescent discharge lamp including a housing having a base, a series electronics located in the housing and including a plate and a circuit element arranged on the plate, and contact means for supplying power to the circuit element and including a first contact position associated with the base, a second contact position provided on the plate, and lead means connecting the first and second contact position and arranged in a free narrowly limited space between the base and the plate, the method comprising the steps of:

forming the lead means as two axially aligned and spaced from each other connection leads and placing a fuse wire in a space between the two connection leads in an alignment relationship with the two connection leads and pressing the two connection leads to opposite ends of the fuse wire so that butt joints are formed between the opposite ends of the fuse wire and respective proximate ends of the two connection leads;

passing an electrical current between the respective proximate ends of the connection leads and the respective opposite ends of the fuse wire so that fusion swellings-forming welds are formed at the butt joints of respective proximate ends of the two connection leads and the respective opposite ends of the fuse wire; and thereafter, securing respective remote ends of the two connection leads to the first and second contact position, respectively.

* * * * *